United States Patent [19]

Dorren

[11] 3,967,069

[45]*June 29, 1976

[54] COMPATIBLE FOUR CHANNEL FM SYSTEM

[75] Inventor: Louis Dorren, Millbrae, Calif.

[73] Assignee: Matsushita Electric Corporation of America, Secaucus, N.J.

[ * ] Notice: The portion of the term of this patent subsequent to Jan. 2, 1990, has been disclaimed.

[22] Filed: June 24, 1974

[21] Appl. No.: 482,415

Related U.S. Application Data

[63] Continuation of Ser. No. 319,939, Dec. 29, 1972, Pat. No. 3,822,365, which is a continuation of Ser. No. 32,989, April 29, 1970, Pat. No. 3,708,623, which is a continuation-in-part of Ser. No. 13,902, Feb. 25, 1970, abandoned.

[52] U.S. Cl. ..... 179/15 BT

[51] Int. Cl.[2] ..... H04H 5/00

[58] Field of Search .... 179/15 BT, 1 GQ, 100.4 ST, 179/100.1 TD

[56] References Cited

UNITED STATES PATENTS

| | | | |
|---|---|---|---|
| 3,708,623 | 1/1973 | Dorren | 179/15 BT |
| 3,822,365 | 7/1974 | Dorren | 179/15 BT |

*Primary Examiner*—Douglas W. Olms

[57] ABSTRACT

A four channel FM system is described. In one embodiment the usual 19 kHz pilot signal is employed to switch between front and rear information, while in another, a 76 kHz switching signal is employed for this purpose.

12 Claims, 15 Drawing Figures

COMPATIBLE FOUR CHANNEL FM SYSTEM

CROSS REFERENCE TO RELATED APPLICATIONS

This is a continuation of application Ser. No. 319,939, now U.S. Pat. No. 3,822,365 filed December 29, 1972, which in turn is a continuation of application Ser. No. 32,989 now U.S. Pat. No. 3,708,623 filed Apr. 29, 1970, which in turn is a continuation-in-part of now abandoned application Serial No. 13,902 filed Feb. 25, 1970.

SUMMARY OF THE INVENTION

A four channel audio system is provided which is fully compatible with standard FM stereo and mono equipment. According to the present invention, a switching or sampling system is employed so that four audio channels are transmitted by the FM station. These four channels are designated left front, right front, left rear and right rear and are sometimes hereinafter abbreviated LF, RF, LR and RR, respectively.

In accordance with one embodiment of the invention, these four channels are superimposed on the 38 kHz subcarrier and the usual 19 kHz pilot signal is used as a switching signal. During the first half cycle of the 19 kHz signal, the left front and right front information is transmitted while during the second half cycle, the left rear and right rear information is transmitted. The 19 kHz pilot is then used as a switching signal between the front and rear information as is hereinafter described in detail while the 38 kHz signal switches between left and right in the usual manner. This system has the advantage of not requiring an increase in bandwidth, not requiring any additional pilot or subcarrier frequencies and permits the radio station to continue to use its normal 67 kHz subcarrier for SCA purposes. However, this embodiment does not ordinarily permit the use of the full frequency spectrum for front and back information so that it is sometimes preferable to provide another subcarrier to carry the front and rear information. When this is done, the 19 kHz pilot signal is quadrupled and this quadrupled signal is used for switching between front and back information.

Both embodiments of the present invention are completely compatible with present mono and stereo equipment. The main channel carries all four audio channels so that on a mono receiver the four audio signals are combined. On a stereo receiver, the left and the right information is extracted in the usual manner and it is only with the receiver equipped for four channel reception that the signal produced by the system of the present invention is broken into its four components. The system utilizing the 76 kHz switching signal has the additional advantage that there is a complete reproduction of the full audio bandwidth by each of the four channels.

The above FIGS. 1 through 9 relate to an embodiment wherein the 19 kHz pilot signal is employed to switch between front and rear information. The following figures relate to that embodiment of the invention wherein a 76 kHz subcarrier and switching signal is employed.

Figure 10:
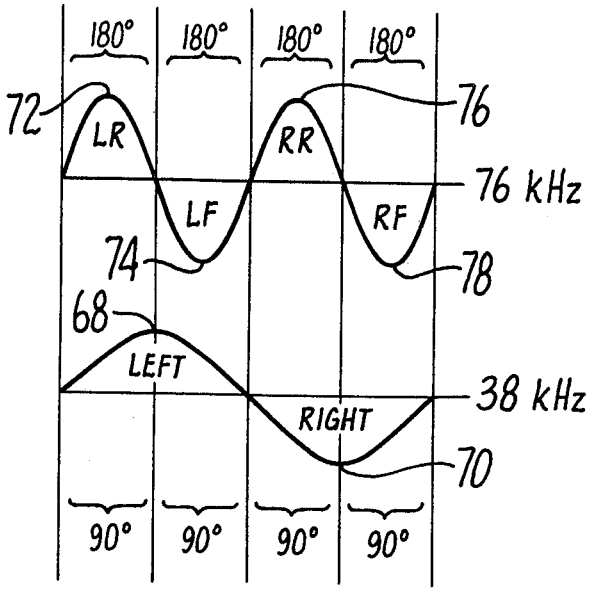

FIG. 10 is a wave form of that embodiment of the invention wherein a 76 kHz subcarrier is employed.

Figure 11:
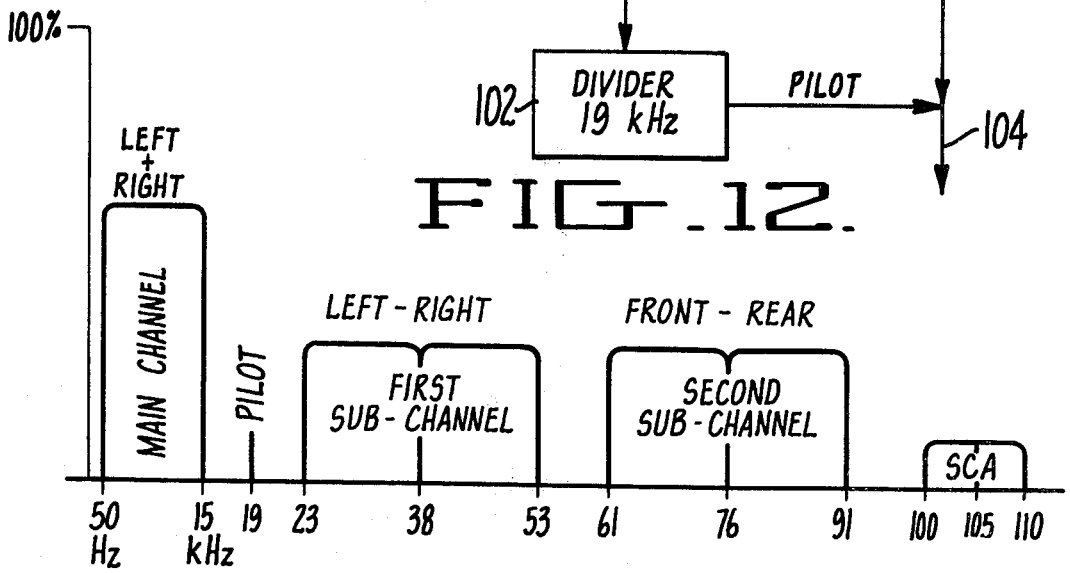

FIG. 11 is a band distribution diagram of the system using the 76 kHz subcarrier.

Figure 12:
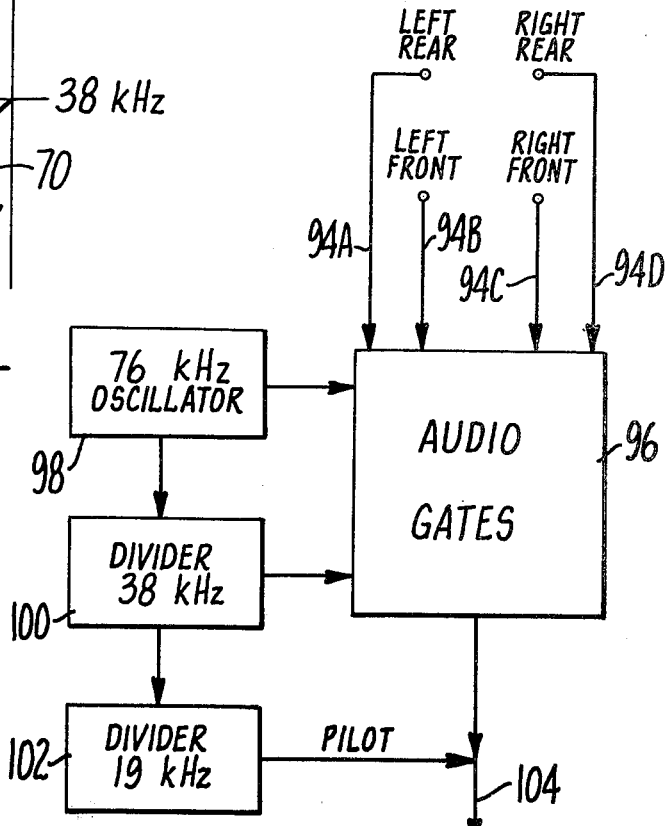

FIG. 12 is a block diagram of the encoder employed with the 76 kHz subcarrier system.

Figure 13:
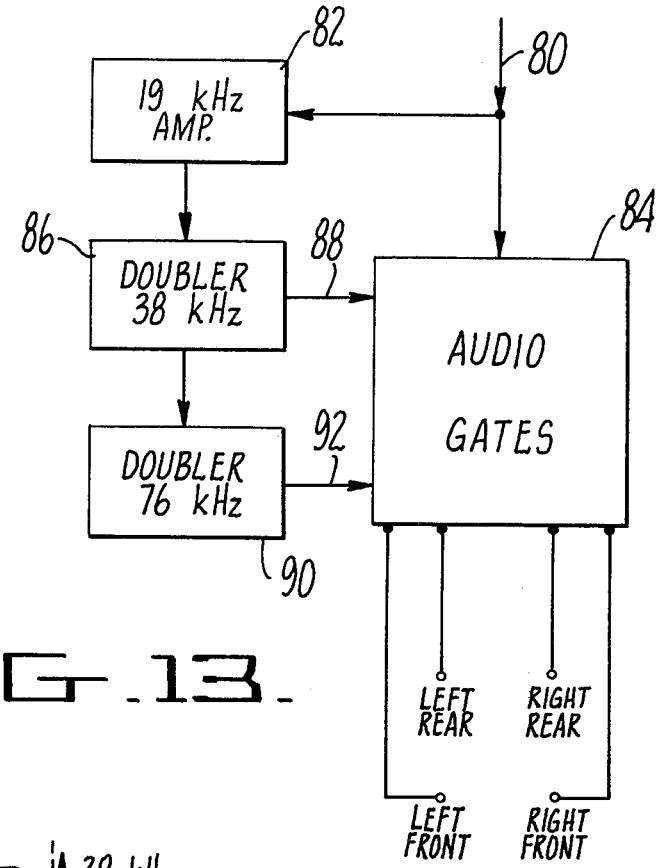

FIG. 13 is a block diagram of the receiver employed with the system.

Figure 14:
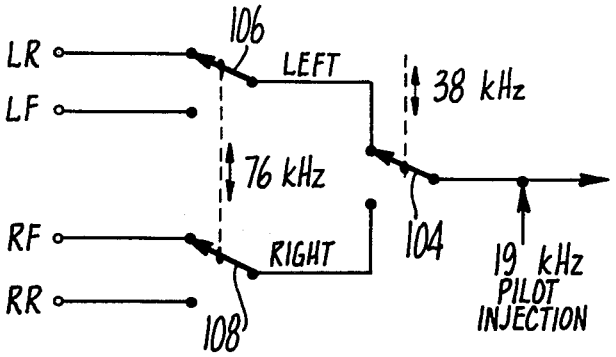

FIG. 14 is a switch analogy for the transmitter.

Figure 15:
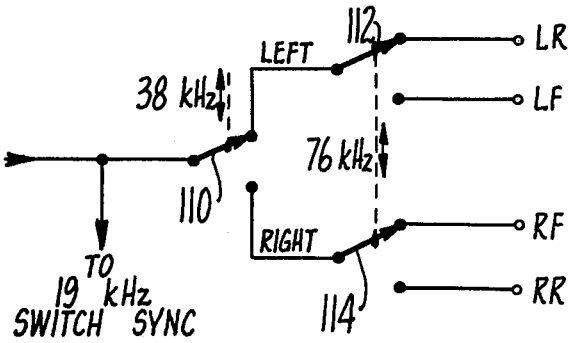

FIG. 15 is a switch analogy for the receiver.

DESCRIPTION OF THE PREFERRED EMBODIMENTS

Reference is made to FIGS. 1 through 9 which illustrate that embodiment of the invention employing a 19 kHz switching signal.

At the present time, the authorized stereophonic system used in the United States includes a multiplex signal wherein left and right channel information is carried on a single carrier wave. The composite signal includes a main channel signal on the carrier frequency which contains both the right and left hand signals. A suppressed carrier double side band signal is provided on a subcarrier at 38 kHz which carries the left minus right signal. A 19 kHz pilot signal is provided for phase lock of the 38 kHz side bands. In addition, there may be a subsidiary communication authorization (S.C.A.) signal at 67 kHz and this system does not interfere with the S.C.A. signal. In general, this embodiment of the invention is carried out by employing the 19 kHz pilot signal as a switching signal to switch between front and back information to provide for front and back as well as left and right signals.

Figure 1:
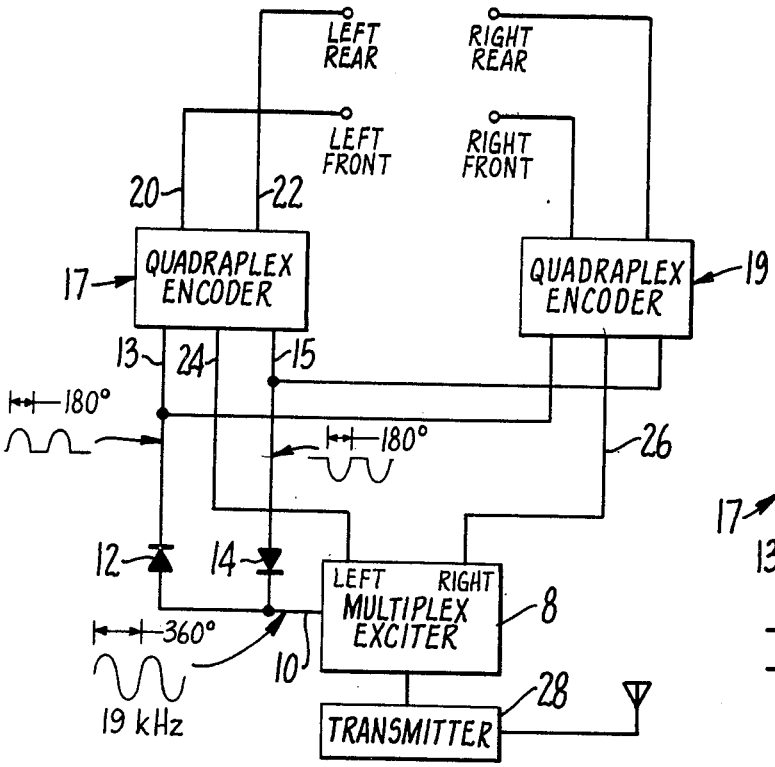
FIG. 1 is a block diagram of a transmitter embodying the present invention.
Figure 3:
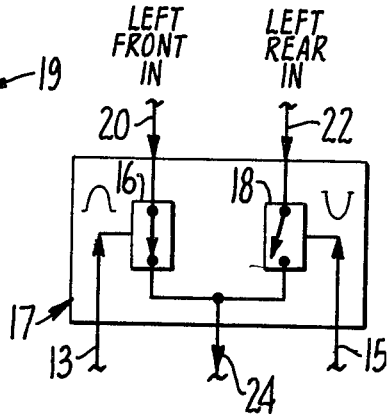
FIG. 3 is an analogy diagram of one of the encoders shown in FIG. 1.

The method of transmitting the signal is shown in FIGS. 1 and 3. A standard multiplex exciter 8 is employed, and this generates a 19 kHz pilot signal which serves as the switching signal for the front and rear information. This signal is passed through lead 10 to diodes 12 and 14 and alternate half cycles are passed by leads 13 and 15 to the encoders 17 and 19. One of these encoders is shown in analog form in FIG. 3 and consists of switches 16 and 18. The encoder has a line 20 leading to switch 16 for front information and a line 22 leading to switch 18 for rear information and a common output line 24. The switches are actuated by pulses from lines 13 and 15 respectively. Thus, on a positive half cycle of the 19 kHz sgnal, switch 16 is closed so that the front information is fed through line 24 while on the following negative half cycle, switch 18 is closed so that the rear information is fed through line 24. The other encoder is not described since it operates in exactly the same way with the right front and rear information. The left information is fed through line 24 to the multiplex exciter 8 while the corresponding right channel information is fed through line 26 to the exciter. The signal generated by the exciter is then fed to the transmitter 28.

Figure 5:
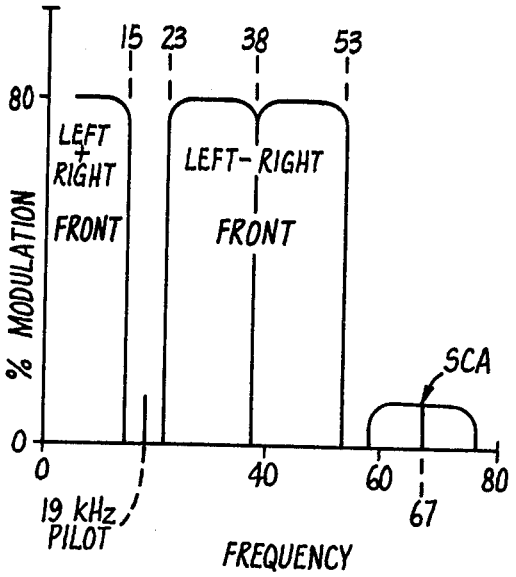
FIG. 5 is a spectrum diagram of the signal employed during the transmission of front channel information.
Figure 6:
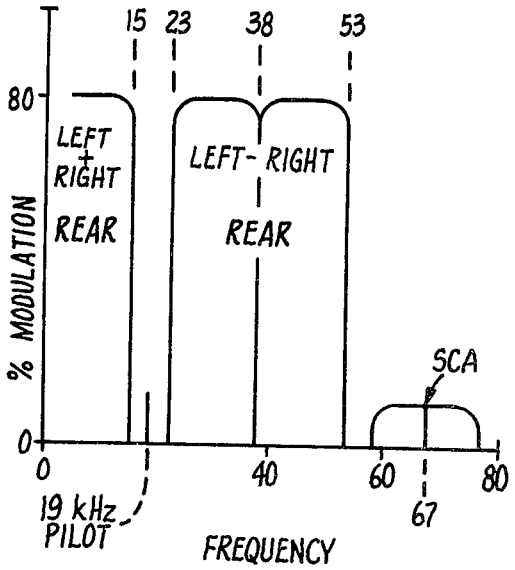
FIG. 6 is a similar diagram showing the signal employed during the transmission of rear channel information.

The signal thus generated can best be understood by reference to FIGS. 5 and 6. FIG. 5 represents the signal as it is being transmitted during the first or positive half cycle of the 19 kHz signal. It will be seen that a 0 frequency (zero in this sense represents the nominal carrier frequency of the FM station) there is present up to 15 kHz, a signal representing the left front plus right front information. Centered on 38 kHz is the left front minus right front information. In FIG. 6 the signal is shown during the second or negative half cycle of the 19 kHz signal. During this half cycle, the main channel is carrying the left plus right information but in this case it is the rear information while similarly centered on 38 kHz the left minus right information is sent but here again it is the rear information. It will be seen that in both instances, there is no interference with the normal S.C.A. signal.

Figure 2:
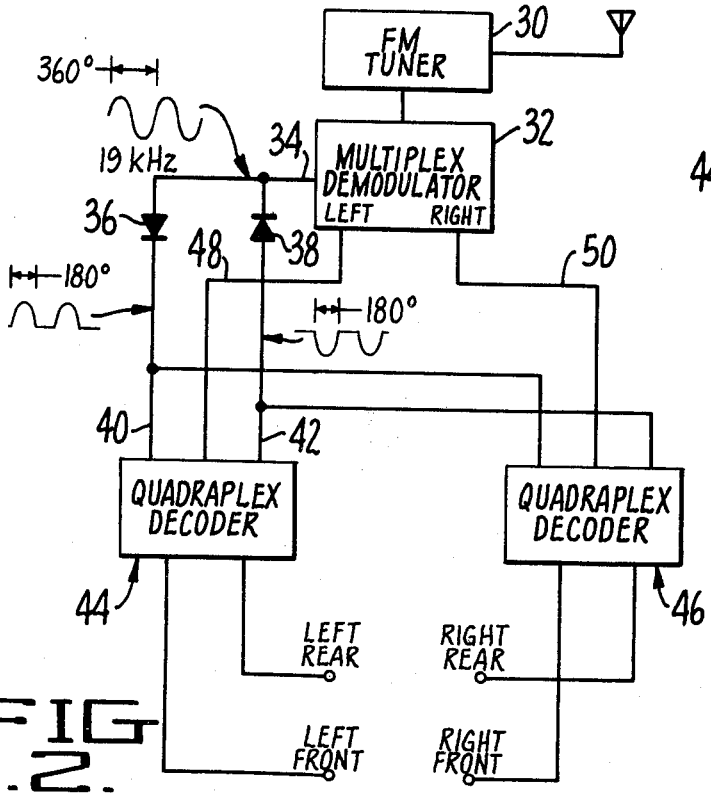
FIG. 2 is a block diagram of a receiver embodying the present invention.
Figure 4:
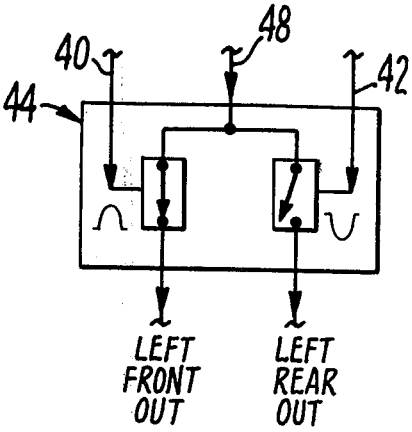
FIG. 4 is a similar diagram of one of the decoders utilized in FIG. 2.

The method of receiving a signal is shown in FIGS. 2 and 4. The signal is received on an ordinary FM tuner 30 and fed to a standard multiplex demodulator 32. The 19 kHz signal is taken from line 34 and passed to diodes 36 and 38 and the rectified 19 kHz pulses are passed through lines 40 and 42 to the decoders 44 and 46. The left and right channel information is taken from the demodulator 32 and passed through lines 48 and 50 to the respective decoders. Referring now specifically to FIG. 4, the upper switch is actuated by the positive half cycles from line 40 while the lower switch is operated by the negative half cycles from line 42 so that the decoder switches between the left front and the right front on positive and negative pulses of the 19 kHz signal. The signals are then taken from the decoder and amplified in the usual way. At the same time, the right channel information is handled in the same manner by the decoder 46.

In order to prevent high frequency components of the incoming program information from interfering with operation of the system, low pass filters which pass only frequencies below 15 kHz are employed in the input leads to the encoders, i.e. leads 20 and 22 of encoder 17 are the corresponding leads of the right hand encoder 19. Similar low pass filters are also employed in the output leads of decoders 44 and 46.

Figure 7:
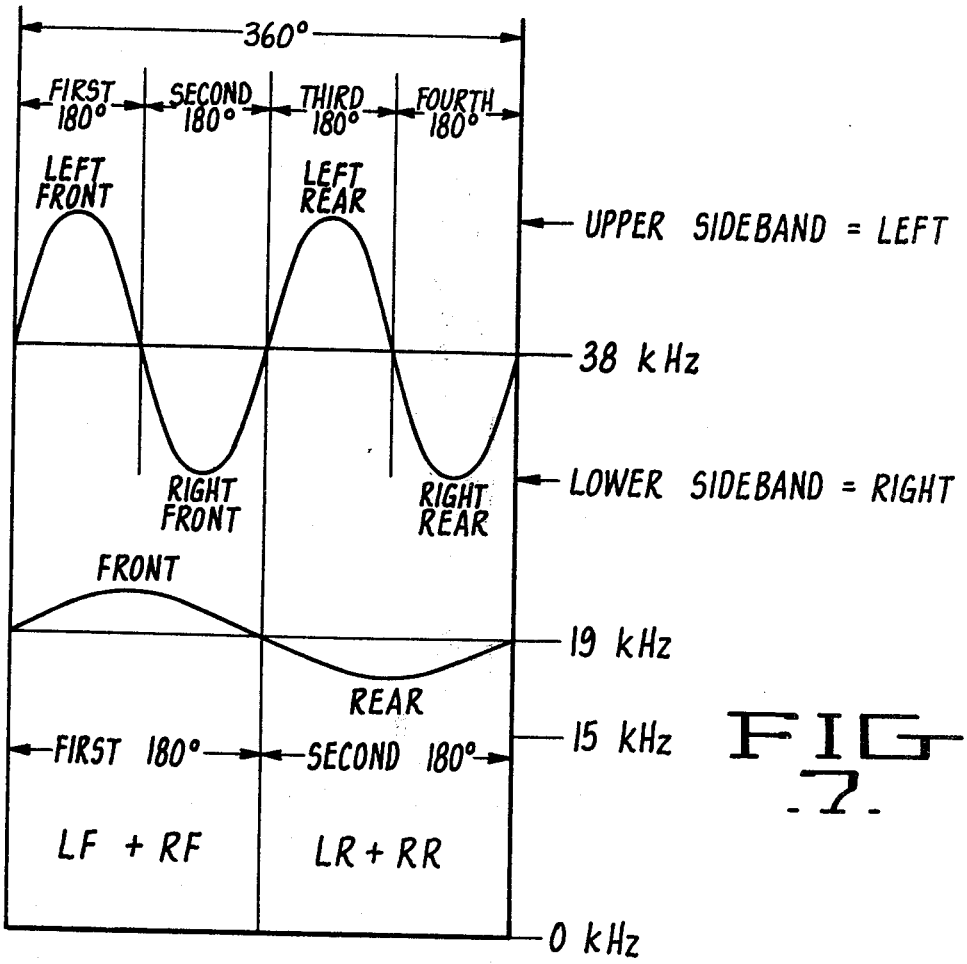
FIG. 7 is a diagram of the composite wave form employed.

The operation of the overall system can best be seen in FIG. 7 wherein it is assumed that demodulation takes place on a time division basis although it will be obvious that the invention is equally applicable to demodulators which operate on a matrixing system or a combination of time division and matrixing. FIG. 7 represents one complete cycle of the 19 kHz signal and two complete cycles of the 38 kHz subcarrier. During the first half of the 19 kHz cycle, front information exclusively is being sent both on the main channel and on the 38 kHz subcarrier. In the case of the main channel, this is a combination of the left front and right front information while on the 38 kHz subcarrier, left front information is being sent on the upper side band and right front information on the lower side band. During the next half cycle of the 19 kHz signal, the situation is reversed with the main channel carrying left rear plus right rear information while on the 38 kHz signal, left rear information is carried on the upper side band while right rear information is carried on the lower side band.

Although the embodiment heretofore described is a fully workable system, some modifications can be made for optimum results.

Figure 8:
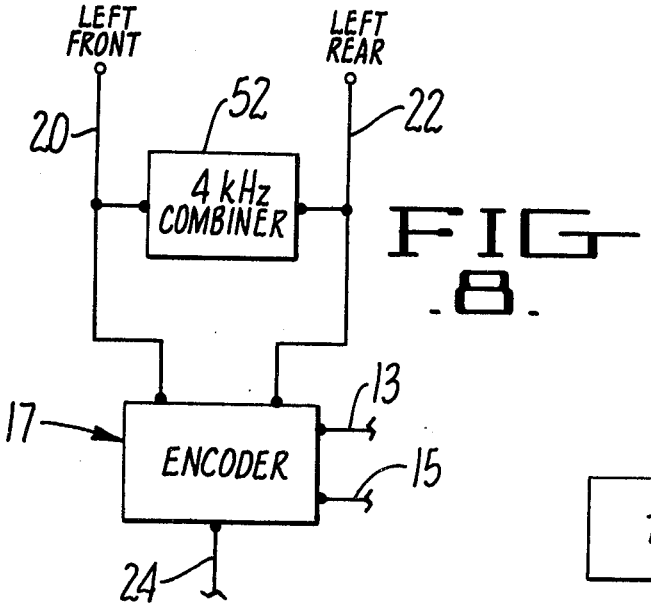
FIG. 8 is a block diagram showing how combiner networks can be employed with the encoders to eliminate beat notes.

When the full bandwidth of 15 kHz is transmitted with this signal, a 15 kHz audio tone will produce sidebands of 4 kHz and 34 kHz when imposed on the 19 kHz pilot signal. The 34 kHz signal will beat with sideband components of the 38 kHz subchannel causing beat frequencies in the sub and main channels, and the 4 kHz signal will beat with the main channel audio components, creating beat frequencies lying within the audible range. Thus, to employ the full 15 kHz bandwidth, it is desirable to provide a combining network on the input to the encoder as is shown in FIG. 8. Here the left channel encoder 17 having the inputs 20 and 22, previously described, has a combining network 52 connected between the input lines. Obviously the right channel is treated the same way. This combining network combines all frequencies above 4 kHz so that for the higher frequencies, the information is carried on both the front and the rear channels. At frequencies under 4 kHz there is a separation between front and back. This gives very good presence since it has been found that a great deal of the separation presence occurs below 4 kHz.

Figure 9:
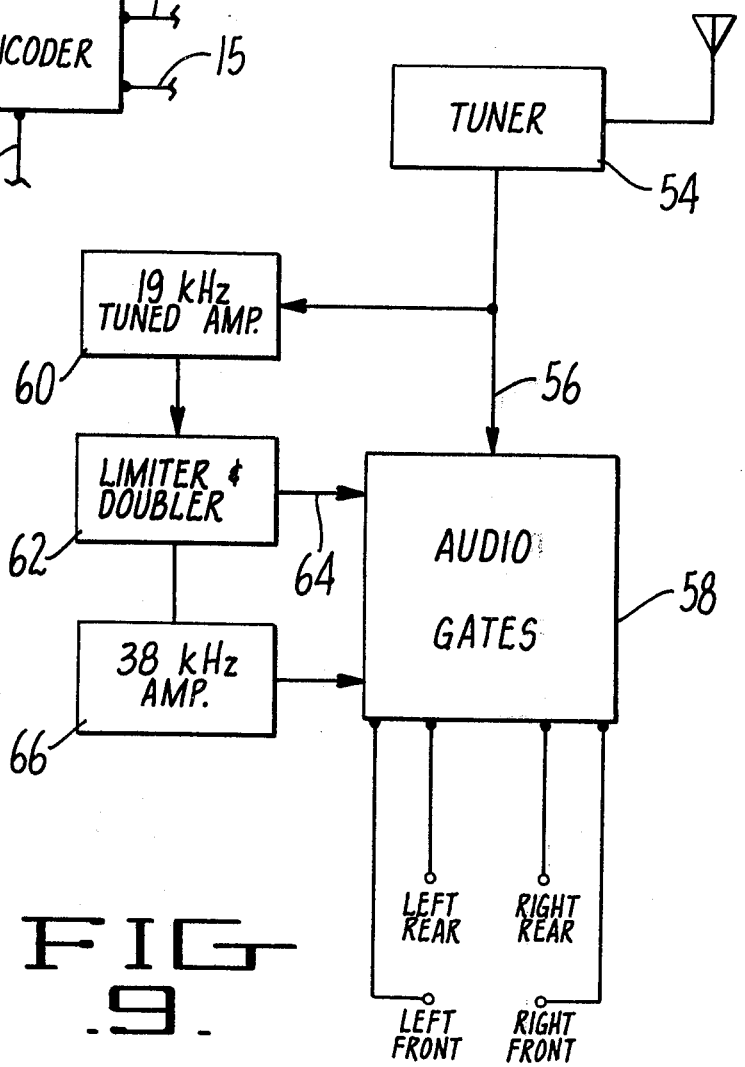
FIG. 9 is a block diagram showing a limiter circuit which is desirable to employ with certain types of FM receivers.

With some relatively inexpensive FM receivers, some distortion may be encountered for the reason that such receivers employ a 19 kHz tuned amplifier together with a doubler. The 19 kHz signal in the case of such receiver is not a clean 19 kHz but has certain modulation components imposed thereon. In other words, the 19 kHz switching signal contains amplitude modulated components so that switching does not always take place at the exact points desired. In order to remedy this, a limiter as is shown in FIG. 9 may be employed with such receivers. Here the tuner 54 feeds a signal through line 56 to the audio gates 58 and at the same time the signal is fed to the 19 kHz tuned amplifier 60. The 19 kHz signal is now passed to the limiter and doubler 62. The limited 19 kHz signal is passed through line 64 to the audio gates to perform the switching function and, since it is now free of all amplituded modulated components, provides a clean switching action. The doubled signal is fed to the 38 kHz amplifier 66 which serves as the switching signal for the right and left information in the usual manner. Most FM receivers do not require this added circuitry, particularly the better grade of receivers which use a phase locked oscillator rather than the simple tuned amplifier and doubler.

The same basic system is used in the scheme shown in FIGS. 10 through 15 except here instead of using the 19 kHz signal to switch between front and rear information, the 19 kHz signal is first doubled in the usual manner to act as a switching signal for the left and right information and again doubled to produce a 76 kHz signal which serves to switch the front and rear information. In order to preserve compatibility, the order in which the audio signals are transmitted is changed to LR, LF, RR and RF. It is also necessary to make a change in the bandwidth to handle the system and in the specific system described, this must be at least 91 kHz for the four channel transmission and it may be increased to 110 kHz to handle S.C.A. subcarrier.

In FIG. 11, one half of the composite signal is shown. Thus, there is a main channel in the usual manner extending from 50 Hz to 15 kHz and this contains the left plus right information, both front and rear. There is a pilot signal at 19 kHz and a first subchannel centered on 38 kHz. This first subchannel contains the left minus right information, including both front and rear. A second subchannel is centered on 76 kHz and this contains the front minus rear information. Summing up the above, it can be seen that the novel composite signal of the present invention includes the following:

A main channel extending up to 15 kHz and including the sum of the signals, for example, left and right both front and rear.

A 19 kHz pilot signal. A first sub-channel centered on 38 kHz containing left minus right information.

A sub-channel centered on 76 kHz containing front minus rear information.

If this signal is studied, purely mathematical Fourier analysis shows that the following signal equations actually exist. The first of these equations is assigned to the main channel and is the sum of the signals, i.e., (LF+LR+RF+RR); this main channel extending up to 15 kHz. The second equation is (LF+LR−RF−RR) and is located in the first sub-channel which is centered at 38 kHz. Also located in the first sub-channel is another equation (LF−LR−RF+RR). To differentiate these two equations, they are modulated in quadrature; that is, the first being the sine of 38 kHz and the second being the cosine of 38 kHz. The final equation is centered at 76 kHz is (LF−LR+RF−RR).

With the production of these four equations in the base band signal, we have now satisfied the algebraic conditions of transmission. The purely mathematical Fourier analysis is as follows:

ANALYTICAL DESCRIPTION OF THE DORREN QUADRAPLEX COMPOSITE SIGNAL

Notation:

ai (t): Audio signal applied to channel I; I = 1, 2, 3, & 4.

si (t): Modulating function of channel I, that is, so that ai (t), si (t) is the contribution of channel I to the composite signal.

c (t): Composite signal. f: Frequency of pilot 19 kilohertz. t: One period of 38 kilohertz of sinusoid 2ft. = 1.

ANALYSIS: THE MODULATING FUNCTION OF FOUR CHANNELS

The modulating functions of four channels are assumed to vary in the ways shown below.

The origin of the time scale is chosen as the beginning of one of the sampling pulses:

sl (t):

$$s2\ (t) = s1\ (t - t/4)$$
$$s3\ (t) = s2\ (t - t/4)$$

$$s4\ (t) = s3\ (t - t/4)$$

*si* (*t*) is a periodic function with a fundamental frequency 2*f* and has a fourier series representation:

$$s1\ (t) = \frac{E}{4}\left\{ 1 + \sum_{n=1}^{\infty} \frac{4}{n\pi} \sin \frac{n\pi}{2} \cos in\ 4\pi\ nft + \sum_{n=1}^{\infty} \frac{4}{n\pi} \left(1 - \cos in \frac{n\pi}{2}\right) \sin 4\pi\ nft. \right\}$$

Retaining only the 38 kilohertz and 76 kilohertz components and applying the relations of one to generate the other three functions, we get:

$$s1\ (t) = \frac{E}{4}\left\{ 1 + \frac{4}{\pi} \text{cosine } 4\pi ft + \frac{4}{\pi} \text{ sine } 4\pi ft + \frac{4}{\pi} \text{sine } 8\pi ft. \right\}$$

$$s2\ (t) = \frac{E}{4}\left\{ 1 - \frac{4}{\pi} \text{cosine } 4\pi ft + \frac{4}{\pi} \text{ sine } 4\pi ft - \frac{4}{\pi} \text{sine } 8\pi ft. \right\}$$

$$s3\ (t) = \frac{E}{4}\left\{ 1 - \frac{4}{\pi} \text{cosine } 4\pi ft - \frac{4}{\pi} \text{ sine } 4\pi ft + \frac{4}{\pi} \text{sine } 8\pi ft. \right\}$$

$$s4\ (t) = \frac{E}{4}\left\{ 1 + \frac{4}{\pi} \text{cosine } 4\pi ft - \frac{4}{\pi} \text{ sine } 4\pi ft - \frac{4}{\pi} \text{sine } 8\pi ft. \right\}$$

Multiplying si (t) by ai (t) and summing to give the composite, we get:

$$c\ (t) = \frac{E}{4}\left\{ a1 + a2 + a3 + a4 + (a1 + a2 - a3 - a4) \text{ sine } 4\pi ft + (a1 - a2 - a3 + a4) \text{ cosine } 4\pi ft + (a1 - a2 + a3 - a4) \text{ sine } 8\pi ft. \right\}$$

To this signal a pilot should be added of the form A sin $2\pi$ft. We see that the quadraplex composite signal consists of:

1. a main channel component ($a1 + a2 + a3 + a4$).
2. two 38 kilohertz components in quadrature, one modulated by ($a1 + a2 - a3 - a4$) and the other modulated by ($a1 - a2 - a3 + a4$).
3. one 76 kilohertz component modulated by ($a1 - a2 + a3 - a4$).

If we make the following channel identification, $a1$ = left front signal
$a2$ = left rear signal
$a3$ = right front signal
$a4$ = right rear signal and assume the two channel stereo case in which, $a1 = a2$ = left
$a3 = a4$ = right the composite signal reduces to c (t) = (E/4) (21 + 2*r*) + A sin $2\pi ft$ + (21 − 2*r*) sin $4\pi ft$. This is the standard two channel stereo format with the pilot at 19 kilohertz and having the correct phase relationship to the 38 kilohertz subcarrier.

This composite signal is generated by the transmitter circuit as shown in FIG. 12 and the switch analogy as shown in FIG. 14 wherein the switch analogy switches at the rates of 76 kHz and 38 kHz. If an S.C.A. signal is desired, this can be centered on 105 kHz, although the provision for such a signal forms no part of the present invention.

In FIG. 10, the sampling system is shown. There is shown one full cycle of the 38 kHz subcarrier and naturally two cycles of the newly generated 76 kHz subcarrier. The 38 kHz signal is utilized by a stereophonic receiver in the usual manner so that the sampling points would be at points 68 and 70 for the left and right handed information. Similarly, the signal centered on the 76 kHz subcarrier contains the front minus rear information so that on a four channel audio system the sampling points would be at 72, 74, 76 and 78 to extract the desired information.

In FIG. 13 there is shown a block diagram of how the decoder works. The composite signal comes from the tuner through line 80 and a portion of the composite signal goes to the 19 kHz amplifier 82. The composite signal is also fed to the audio gates 84. The 19 kHz signal is doubled to 38 kHz in the doubler 86 and this signal is passed through line 88 to the audio gate 84 where it is used to switch between the right and left information. A portion of the signal is also sent to the second doubler 90 which puts out a signal at 76 kHz through line 92 which is also sent to the audio gates and utilized to switch between front and back information.

The transmitter circuit is shown in FIG. 12 and essentially consists of the opposite circuit from that described for the decoder. Thus, four sources of audio are supplied through the four lines 94 A, B, C and D to the audio gates 96. A 76 kHz oscillator 98 is provided which sends a signal to the audio gates for switching between the front and the back information. The signal is divided by two in divider 100 and a portion of this 38 kHz signal is sent to the audio gates for switching between right and left information while a portion of this signal is sent to the divider 102 for the generation of the 19 kHz pilot signal. The pilot signal is combined with the composite signal from the audio gates to produce a composite signal on 104 which can be used to modulate a standard FM transmitter. Naturally this signal will look like the signal of FIG. 11 except that no description has been included of the generation of the SCA band.

FIG. 14 shows a mechanical switch analogy of the switching circuit and this as well as FIG. 15 should be utilized in conjunction with FIG. 10. Here switch 104 operates at a frequency of 38 kHz for sampling the right and left information while switch 106 operates at twice this frequency for sampling the left rear and left front information while switch 108 operates at the same frequency for the same purpose in the right channel. Thus one can visualize switch 104 in the upper position while switches 106 and 108 are also in the upper position. Switch 108 is in effect inoperative since the right channel is open but switch 106 switches the left rear information into the outgoing signal. Now switch 106 (as well as 108) moves to the lower position so that the left front information is sampled. After one complete cycle of the 76 kHz, switch 104 moves to the lower position while switch 108 repeats the operation for sampling the right front and rear information. FIG. 15 gives a similar analogy for the receiver where switch 110 operating at a frequency of 38 kHz switches between right and left information while switches 112 and 114 similarly switch between front and rear informaton. Naturally, these are only mechanical analogies and in a normal receiver or transmitter such switching is by solid state devices.

It will be apparent from this description that the signal is completely compatible with either a mono, stereo, or four channel receiver. Thus, on a mono receiver, one would hear the main channel which during 2 cycles of the 76 kHz subcarrier will contain the information from all four channels. On a stereo receiver, left front and left rear information will be extracted during the first 180° period of the 38 kHz subcarrier while the right front and right rear information will be received during the second 180° period. On the four channel receiver, the four signals would be individually received as previously described.

It will be seen from the description which has been given that the complete signal of the first embodiment has been contained within the assigned bandwidth and that there has been no interference with an S.C.A. signal, if this is being sent. In the second embodiment the four signals are all modulated to the full 15 kHz bandwidth so that there is no deterioration of separation over this bandwidth. The four signals are also given the same percentage of modulation so there is no deterioration of the signal to noise ratio.

I claim:

1. A four channel FM system comprising means for transmitting a carrier wave frequency-modulated in accordance with the modulating function:

$C(t) = (A+B+C+D) + (A+B-C-D)\text{sine } 2w_s t + (A-B-C+D)\text{cosine } 2w_s t + (A-B+C-D)\text{sine } 4w_s t + K\sin w_s t$ in which A, B, C, D are audio signals, K is the amplitude of the reference pilot signal $\sin w_s t$, $w_s = 2\pi f_s$, where $f_s$ is the fundamental frequency of the pilot signal, $\sin 2w_s t$, cosine $2w_s t$ and sine $4w_s t$ are sub-carrier signals, each sub-carrier signal being suppressed-carrier double sideband amplitude modulated by said audio signals, and receiver means operative in response to the reception of said frequency modulated carrier for reproducing each of said audio signals.

2. In a four channel FM transmission system for providing four quadraphonically related audio frequency signals designated as A, B, C and D, means for generating a pilot signal of a first predetermined frequency, means for generating a first subcarrier signal at twice the frequency of said pilot signal, means for generating a second subcarrier signal at twice the frequency of said pilot signal and in quadrature with said first subcarrier signal, means for generating a third subcarrier signal centered at the four times the frequency of said pilot signal, means for transmitting said four quadraphonically related audio signals including means for adding said audio signals to obtain a sum combination audio signal, means for producing an amplitude modulated suppressed-carrier double sideband first subcarrier signal, said first subcarrier signal being amplitude modulated by a signal representative of (A+B−C−D) combination audio signals, means for producing an amplitude modulated signal suppressed-carrier double sideband second subcarrier signal, said second subcarrier signal being amplitude modulated by a signal representative of (A−B−C+D) combination audio signals, and means for producing an amplitude modulated suppressed-carrier double sideband third subcarrier signal, said third subcarrier signal being amplitude modulated by a signal representative of (A−B+C−D) combination audio signals, and means for frequency modulating a high frequency carrier signal with said signals for transmitting same to one or more remote receivers.

3. A four channel system as defined in claim 2, further including receiver means operative in response to the reception of said high frequency carrier to reproduce each of said audio frequency signals.

4. A four channel system as defined in claim 3 wherein said receiver means includes means for reproducing conventional monophonic and two channel stereophonic broadcasts.

5. A four channel system as defined in claim 3 wherein said receiver means includes means for extracting said pilot signal from said received composite signal, and means operative in response to said pilot signal for reproducing said individual audio signals.

6. A four channel system of claim 5 further including means responsive to said pilot signal for producing a first signal at the frequency of said first subcarrier and means responsive to said pilot signal for producing a second signal at the frequency of said third subcarrier signal, and means responsive to said first and second signals including means for producing said four audio signals under the control of said first and second signals.

7. A four channel FM transmission system for transmitting four quadraphonically related audio signals comprising means for producing a composite audio signal including means for producing a first combination of said audio signals in a lower frequency audio range; means for producing a pilot signal at a first frequency, means for producing a first subcarrier signal at a frequency double the frequency of said pilot signal, means for producing amplitude modulation of said first subcarrier signal with a second combination of said four audio signals in a manner to provide an amplitude modulated, suppressed-carrier double sideband signal, means for producing a second subcarrier signal at a frequency double the frequency of said pilot signal and in quadrature with the first subcarrier signal, means for producing amplitude modulation of said second subcarrier signal with a third combination of said audio signals in a manner to provide an amplitude modulated, suppressed-carrier, double sideband signal, means for producing a third subcarrier signal at a frequency quadruple the frequency of said pilot signal, means for producing amplitude modulation of said third subcarrier signal with a fourth combination of said audio signal in a manner to provide an amplitude modulated, suppressed-carrier, double sideband signal, and means for frequency modulating a high frequency carrier signal with said signals for transmission to one or more remote receivers.

8. A receiver for a four channel FM system for utilizing a transmitted carrier wave frequency modulated in accordance with the modulation function:

$C(t) = (A+B+C+D) + (A+B-C-D) \sin 2w_s t + (A-B-C+D) \cos 2w_s t + (A-B+C-D) \sin 4w_s t + K \sin w_s t$ in which A, B, C, D are audio signals, K is the amplitude of the reference pilot signal $w_s t$, $w_s = 2\pi f_s$, where $f_s$ is the fundamental frequency of the pilot signal, $\sin 2w_s t$, $\cos 2w_s t$ and $\sin 4w_s t$ are sub-carrier signals, comprising means responsive to said composite signal for producing a first signal at the frequency of said pilot signal, means for producing a first sub-carrier signal at a frequency double the frequency of said pilot signal, means for producing a second subcarrier signal at a frequency double the frequency of said first sub-carrier signal, means responsive to said composite signal, said first sub-carrier signal and said second sub-carrier signal for producing said individual audio signals.

9. In a receiver for deriving at least one of first, second, third and fourth quadraphinically related audio frequency signals from a composite signal including frequency components in the form of (a) the sidebands of a first combination of said audio frequency signals amplitude modulated on a first suppressed sub-carrier wave of a given frequency; (b) a second combination of said four audio frequency signals lying in a frequency band lower in frequency than said sidebands and separated therefrom by a frequency gap, (c) the sidebands of a third combination of said audio frequency signals amplutude modulated on a suppressed carrier wave of a given frequency equal to the frequency of said first suppressed carrier wave and in quadrature therewith, (d) the sidebands of a fourth combination of said audio frequency signals amplitude modulated on a suppressed carrier wave of a frequency double the frequency of said first sub-carrier wave and (e) a pilot signal at a frequency equal to one-half the frequency of said first suppressed sub-carrier wave and which lies in said frequency gap, the combination of frequency multiplier means including a frequency selective circuit selectively responsive to frequencies within said frequency gap and responsive to said pilot signal for providing signals at the frequency of said first and second sub-carrier waves under the control of said pilot signal and circuit means coupled to receive said composite signal and said signals at the frequency of said first and second sub-carrier wave for deriving said first, second, third and fourth audio frequency signals from said composite signal.

10. In a receiver for deriving quadraphonically related audio frequency signals from a composite signal of the form:

$C(t) = (A+B+C+D) + (A+B-C-D) \sin 2w_s t + (A-B-C+D) \cos 2w_s t + (A-B+C-D) \sin 4w_s t + K \sin w_s t$ in which A, B, C, and D are audio signals, K is the amplitude of the reference pilot signal $\sin w_s t$, $w_s = 2\pi f_s$ where $f_s$ is the fundamental frequency of the pilot signal, $\sin 2w_s t$, $\cos 2w_s t$ and $\sin 4w_s t$ are sub-carrier signals, the combination comprising means responsive to said composite signal for producing a signal at the frequency of said pilot signal, means responsive to the pilot signal for producing a first reference signal at double the frequency of said pilot signal and means responsive to said pilot signal for producing a second reference signal at quadruple the frequency of said pilot signal, and circuit means responsive to said reference signals and said composite signal for producing said audio signals under the control of said reference signals.

11. In a receiver for deriving at least one of first, second, third and fourth quadraphonically related audio frequency signals from a composite signal comprising a first combination of audio signals of a lower frequency band, a pilot signal having a frequency higher than the highest frequency of said audio signals, a second combination of said audio signals amplitude modulating a first subcarrier signal at a frequency double the frequency of said pilot signal, a third combination of said audio signals amplitude modulating a second subcarrier at a frequency double the frequency of said pilot signal and in quadrature with said second subcarrier signal, a fourth combination of said audio signals amplitude modulating a third subcarrier signal at a frequency quadruple the frequency of said pilot signal, the combination of means responsive to said composite signal for deriving said pilot signal, means under the control of said pilot signal for deriving said first, second and third subcarrier signals, and means responsive to said subcarrier signals and the components of said composite signal for deriving said first, second, third and fourth audio signals.

12. In a four channel FM transmission system utilizing four quadraphonically related audio frequency signals designated as A, B, C and D, means for generating a pilot signal of a first predetermined frequency, means for generating a first subcarrier signal at twice the frequency of said pilot signal, means for generating a second subcarrier signal at twice the frequency of said pilot signal and in quadrature with said first subcarrier signal, means for generating a third subcarrier signal centered at four times the frequency of said pilot signal, means for transmitting said four quadraphonically related audio signals including means for combining said audio signals to obtain first, second, third and fourth combinations of said audio signals, means responsive to said second combination of audio signals and said first subcarrier signal for producing an amplitude modulated suppressed subcarrier first signal, means responsive to said third combination of audio signals and said second subcarrier signal for producing an amplitude modulated suppressed subcarrier second signal, means responsive to said fourth combination of audio signals and said third subcarrier signal for producing an amplitude modulated suppressed subcarrier third signal, and means for frequency modulating a high frequency carrier signal with said first combination of audio signals, said first signal, said second signal and said third signal for transmitting same to one or more remote receivers.

* * * * *